US011613957B1

(12) United States Patent
Zahur et al.

(10) Patent No.: US 11,613,957 B1
(45) Date of Patent: Mar. 28, 2023

(54) METHOD AND SYSTEM FOR HIGH SHUT-IN PRESSURE WELLS

(71) Applicant: Saudi Arabian Oil Company, Dhahran (SA)

(72) Inventors: Jawad Zahur, Abqaiq (SA); Mohammed H. Al Madan, Al Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/587,201

(22) Filed: Jan. 28, 2022

(51) Int. Cl.
*E21B 33/127* (2006.01)
*E21B 34/08* (2006.01)

(52) U.S. Cl.
CPC ..... *E21B 33/127* (2013.01); *E21B 34/08* (2013.01); *E21B 2200/05* (2020.05)

(58) Field of Classification Search
CPC ..... E21B 33/127; E21B 34/08; E21B 2200/05
See application file for complete search history.

(56) References Cited

U.S. PATENT DOCUMENTS

| | | | | |
|---|---|---|---|---|
| 5,564,502 | A | 10/1996 | Crow et al. | |
| 5,871,047 | A | 2/1999 | Spath et al. | |
| 6,629,566 | B2 * | 10/2003 | Liknes | E21B 43/122 166/372 |
| 7,478,024 | B2 | 1/2009 | Gurpinar et al. | |
| 9,745,833 | B2 | 8/2017 | Carvajal et al. | |
| 10,133,831 | B2 | 11/2018 | Carvajal et al. | |
| 2007/0198234 | A1 | 8/2007 | Zangi et al. | |
| 2010/0023269 | A1 | 1/2010 | Yusti et al. | |
| 2010/0299125 | A1 | 11/2010 | Ding et al. | |
| 2013/0035920 | A1 | 2/2013 | Al-Shammari | |
| 2017/0114619 | A1 | 4/2017 | Conn et al. | |

(Continued)

FOREIGN PATENT DOCUMENTS

| | | |
|---|---|---|
| CN | 102754105 | 10/2012 |
| CN | 103842615 | 6/2014 |

(Continued)

OTHER PUBLICATIONS

U.S. Appl. No. 16/867,825, filed May 6, 2020, Mugharbil et al.

(Continued)

*Primary Examiner* — Matthew R Buck
(74) *Attorney, Agent, or Firm* — Fish & Richardson P.C.

(57) ABSTRACT

The check valve positioned within a production tubing string is configured to open when a differential pressure across the check valve exceeds a specified opening differential pressure. With the check valve closed, a specified volume of gas is flowed from the production tubing string, thereby decreasing the pressure within the production tubing string from a first wellhead pressure to a second, lesser wellhead pressure. Hydrostatic pressure within the production tubing string at the check valve is increased by flowing a specified volume of water into the production tubing string above the check valve to at least partially replace the specified volume of gas. After flowing the water, a specified volume of treatment fluid is injected into the production tubing string at an injection pressure less than the first wellhead pressure and greater than the second wellhead pressure, thereby opening the check valve and flowing the treatment fluid downhole.

18 Claims, 8 Drawing Sheets

(56) References Cited

U.S. PATENT DOCUMENTS

| | | | |
|---|---|---|---|
| 2018/0171761 | A1 | 6/2018 | Schneider et al. |
| 2018/0188403 | A1 | 7/2018 | Halsey et al. |
| 2018/0230780 | A1 | 8/2018 | Klenner et al. |
| 2019/0332960 | A1 | 10/2019 | Zheng et al. |

FOREIGN PATENT DOCUMENTS

| | | |
|---|---|---|
| CN | 105493100 | 4/2016 |
| CN | 105706089 | 6/2016 |
| EP | 2951720 | 12/2015 |
| FR | 2950993 | 2/2013 |
| WO | WO 2016010813 | 1/2016 |
| WO | WO 2016186627 | 11/2016 |
| WO | WO 2017040457 | 3/2017 |
| WO | WO 2017074883 | 5/2017 |
| WO | WO 2017111964 | 6/2017 |
| WO | WO 2017151838 | 9/2017 |
| WO | WO 2017165949 | 10/2017 |
| WO | WO 2018132786 | 7/2018 |

OTHER PUBLICATIONS

U.S. Appl. No. 16/907,701, filed Jun. 22, 2020, Mugharbil et al.

Ardian et al., "Recovering Well Productivity in Banyu Urip Field," SPE 165793, Society of Petroleum Engineers (SPE), Oct. 22, 2013, 7 pages.

expro.com [online], "Downhole safety valve (DHSV)," 2022, retrieved on Mar. 11, 2022, retrieved from URL <https://81422d14c097702b6a9f-fdabdf1ed13d1990275f510cf3764dd3.ss1.cf3.rackcdn.com/Downhole-Safety-Valve-DHSV.pdf>, 1 page.

Falcone et al., "Model Predicts More Accurate PI Over a Field's Life," Oil and Gas Journal, Pennwell Houston, Texas, Mar. 19, 2001, 99:12, 5 pages.

hydril.com [online], "Drill Stem Valves," Oct. 2003, retrieved on Mar. 11, 2022, retrieved from URL <https://studylib.es/doc/8929791/drill-stem-valves>, 9 pages.

jmesales.com [online], "Morrison Bros. 529 Series 2 in. NPT brass nipple check valve," 2022, retrieved on Mar. 11, 20922, retrieved from URL <https://www.jmesales.com/morrison-bros-529-series-2-in-npt-brass-nipple-check-valve/>, 5 pages.

morbros.com [online], "Model 529 & 530 series nipple checkvalve," 2022, retrieved on Mar. 11, 2022, retrieved from URL <https://morbros.com/downloads/products/529_530-SS.pdf>, 1 page.

Sawyer et al., "A simulation-based spreadsheet program for history matching and forecasting shale gas production," Society of Petroleum Engineers (SPE), presented at the 1999 SPE Eastern Regional Conference and Exhibition, Charleston, West Virginia, Oct. 1999, 8 pages.

schlumberger.com [online], Conventional Reverse-Flow Check Valves, 2022, retrieved on Mar. 11, 2022, retrieved from URL <https://www.slb.com/-/media/fdes/al/product-sheet/conv-reverse-flow.ashx>, 1 page.

Siu et al., "Re-Engineering the Well Calibration Procedure for a Large Number of High Productivity Wells," SPE 66385, Society of Petroleum Engineers (SPE), Proceedings of SPE Reservoir Simulation Symposium, Jan. 1, 2001, 14 pages.

* cited by examiner

METHOD AND SYSTEM FOR HIGH SHUT-IN PRESSURE WELLS

TECHNICAL FIELD

This disclosure relates to the production of oil, gas, or other resources from subterranean zones to the surface.

BACKGROUND

Hydrocarbons or other resources in subsurface reservoirs or locations below the Earth's surface can be produced to the surface via wells drilled from the surface to the subsurface locations. After drilling, such wells are completed by installing casing and production tubing to provide a pathway for such resources to flow to the surface. It is sometimes necessary or desirable to shut in or close a well and to pump stimulation chemicals or other treatment fluids in a downhole direction through the production tubing while the well is shut in.

SUMMARY

Certain aspects of the subject matter herein can be implemented as a method of injecting fluids in a downhole direction through a production tubing string. The production tubing string is positioned below a wellhead in a well drilled into a subterranean zone. An initial shut-in pressure within the production tubing string at the wellhead is a first wellhead pressure. The method includes closing, while the well is shut in, a check valve positioned at a downhole location within a production tubing string, the check valve operable to prevent fluid from flowing in an uphole direction through the production tubing string and to open to allow fluid in a downhole direction when a differential pressure across the check valve exceeds a specified opening differential pressure. With the check valve closed, a specified volume of gas is flowed from the production tubing string above the check valve, thereby decreasing the pressure within the production tubing string at the wellhead from the first wellhead pressure to a second wellhead pressure less than the first wellhead pressure. A hydrostatic pressure within the production tubing string at the check valve is increased by flowing a specified volume of water into the production tubing string above the check valve to at least partially replace the specified volume of gas. After flowing the specified volume of water into the production tubing string, a specified volume of treatment fluid is injected into the production tubing string at an injection pressure less than the first wellhead pressure and greater than the second wellhead pressure, thereby opening the check valve by causing the differential pressure across the check valve to exceed the specified opening differential pressure and thereby flowing the treatment fluid downhole through the check valve.

An aspect combinable with any of the other aspects can include the following features. The increasing of the hydrostatic pressure from the flowing of the volume of water into the production tubing string can be insufficient to cause the differential pressure across the check valve to exceed the specified opening differential pressure.

An aspect combinable with any of the other aspects can include the following features. The injecting of the treatment fluid after the flowing of the water can be sufficient to cause the differential pressure across the check valve to exceed the specified opening differential pressure.

An aspect combinable with any of the other aspects can include the following features. The method can include calibrating the check valve to open at the specified opening differential pressure based on at least one characteristic of a well treatment job design.

An aspect combinable with any of the other aspects can include the following features. The check valve can be lowered to the downhole location.

An aspect combinable with any of the other aspects can include the following features. Lowering the check valve can be by a slickline.

An aspect combinable with any of the other aspects can include the following features. A landing nipple can be positioned in the production tubing string at the downhole location. Positioning the check valve at the downhole location can include landing the check valve on the landing nipple.

An aspect combinable with any of the other aspects can include the following features. The downhole location can be downhole of a subsurface safety valve.

An aspect combinable with any of the other aspects can include the following features. The check valve can include a packer element configured to selectively expand at the downhole location.

An aspect combinable with any of the other aspects can include the following features. The packer element can be inflatable packer element.

An aspect combinable with any of the other aspects can include the following features. The check valve can be a flapper-type valve.

An aspect combinable with any of the other aspects can include the following features. The check valve can be a first check valve and the method can further include positioning a second check valve downhole of the first check valve, the second check valve configured to open to allow fluid in a downhole direction when a differential pressure across the check valve exceeds the specified opening differential pressure and to prevent fluid from flowing in the uphole direction through the production tubing string in the event of failure of the first check valve.

Certain aspects of the subject matter herein can be implemented as a system for injecting a fluid into a production tubing string. The production tubing string is positioned below a wellhead in a well drilled into a subterranean zone and an initial shut-in pressure within the production tubing string at the wellhead is a first wellhead pressure. The system includes a landing nipple positioned in the production tubing string at a downhole. The system further includes a check valve configured to land on the landing nipple. A check valve is calibrated based on at least one characteristic of a well treatment job design to have a specified calibrated state, the specified calibrated state such that, when the check valve is positioned in the tubing string on the landing nipple, the check valve can close and remain closed as a specified volume of gas from the production tubing string is flowed from the production tubing string above the check valve, thereby decreasing the pressure within the production tubing string at the wellhead from the first wellhead pressure to a second wellhead pressure less than the first wellhead pressure, and as a hydrostatic pressure within the production tubing string at the check valve is increased by flowing a specified volume of water into the production tubing string above the check valve to at least partially replace the specified volume of gas. The configured calibration state is further such that the check valve opens as, after flowing the specified volume of water into the production tubing string and at an injection pressure less than the first wellhead pressure and greater than the second wellhead pressure, a specified volume of treatment fluid is flowed into the production tubing that causes the differential pressure across the check valve to exceed a specified differential pressure at which the check valve opens.

An aspect combinable with any of the other aspects can include the following features. The system can further include a subsurface safety valve positioned in the production tubing string uphole of the landing nipple.

An aspect combinable with any of the other aspects can include the following features. The check valve can include a packer element configured to selectively expand at the downhole location.

An aspect combinable with any of the other aspects can include the following features. The packer element can be an inflatable packer element.

An aspect combinable with any of the other aspects can include the following features. The check valve can be a flapper-type valve.

An aspect combinable with any of the other aspects can include the following features. The check valve can be a first check valve and the system can further include a second check valve positioned downhole of the first check valve. The second check valve can be configured to open to allow fluid in a downhole direction when a differential pressure across the check valve exceeds the specified opening differential pressure and to prevent fluid from flowing in the uphole direction through the production tubing string in the event of failure of the first check valve.

The details of one or more embodiments are set forth in the accompanying drawings and the description below. Other features, objects, and advantages will be apparent from the description and drawings, and from the claims.

DETAILED DESCRIPTION

The details of one or more implementations of the subject matter of this specification are set forth in this detailed description, the accompanying drawings, and the claims. Other features, aspects, and advantages of the subject matter will become apparent from this detailed description, the claims, and the accompanying drawings.

Production wells are sometimes shut in to permanently or temporarily stop the flow of fluids through the production tubing from the subterranean zone to the wellhead of the well. In some circumstances, while a production well is shut in, it is desirable to pump treatment fluids such as water, scale inhibitor, or acid stimulation chemicals downhole through the production tubing string and into the subterranean zone. In order to enter the production tubing, such fluids must be injected at a pressure that exceeds the shut-in pressure. In a well with a high shut-in pressure, the required injection pressure may exceed a maximum allowable injection pressure or other threshold.

In accordance with some embodiments of the present disclosure, a method and system is provided to lower the pressure required to inject treatment fluids in a well having a relatively high initial shut-in pressure, thus enabling such injection while not exceeding the maximum allowable injection pressure or other threshold. In this way, the effectiveness, efficiency, and safety of injection operations can be maximized while minimizing risk, cost and complexity.

Figure 1A:
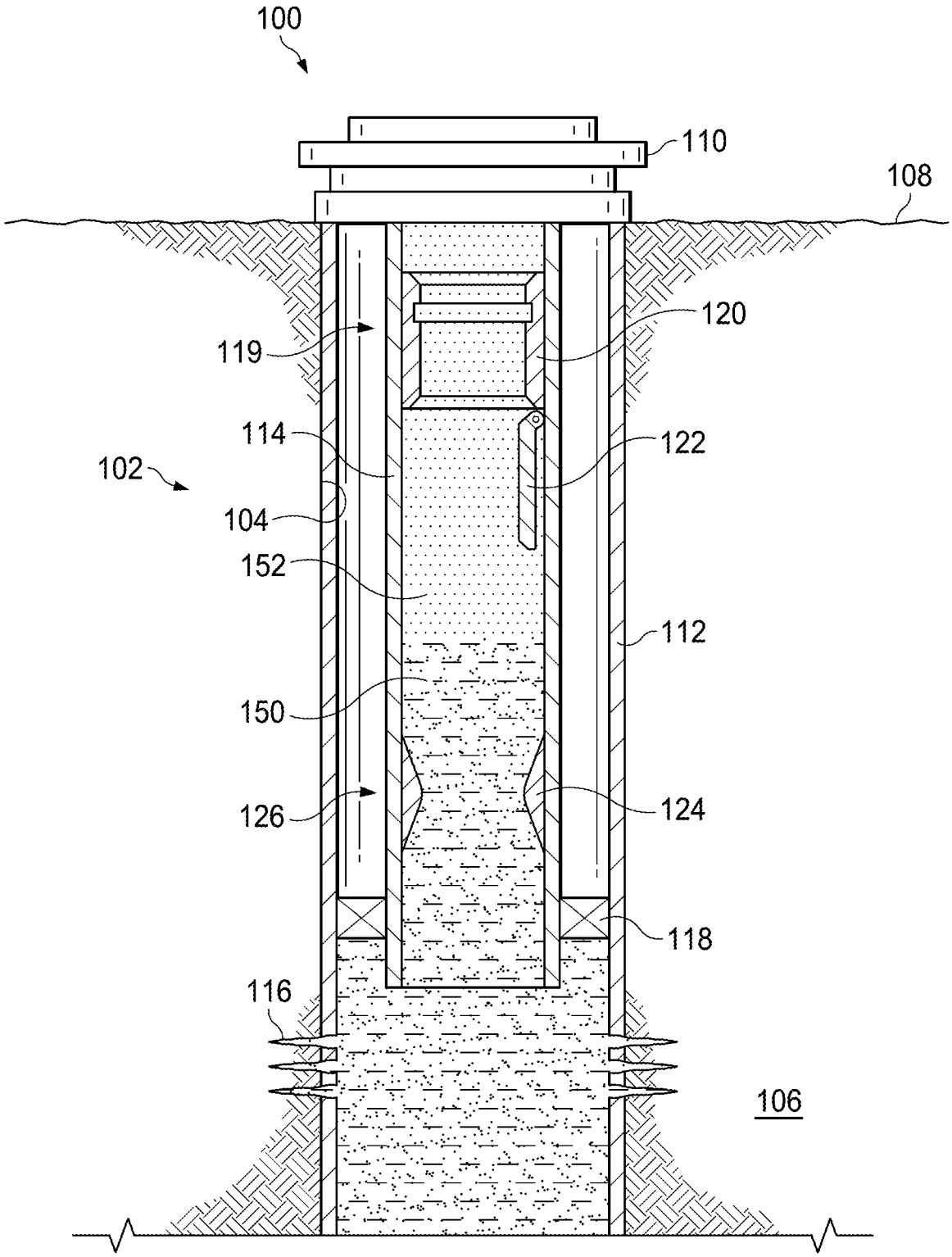
FIGS. 1A-1F are schematic illustrations of injection of a treatment fluid through a check valve in a well system in accordance with an embodiment of the present disclosure.

FIG. 1A is an example of well system 100 in accordance with an embodiment of the present disclosure. Referring to FIG. 1A, well system 100 includes a well 102 comprising a wellbore 104 drilled into a subterranean zone 106 from the surface 108. Well 102 can comprise an oil and/or gas well, water well, or other wellbore drilled into subterranean zone 106 for purposes of oil and/or gas production or other purposes or applications, and can be drilled from a surface (land) location or an offshore location. Wellbore 104 in the illustrated embodiment is substantially vertical but in some embodiments can include both vertical and other-than-vertical (such as substantially horizontal) portions, and can comprise a single wellbore or can include multiple lateral wellbores. Well system 100 further includes a wellhead 110 which can include various spools, valves and adapters to provide pressure and flow control for well 102. The term "uphole" as used herein means in the direction along the production tubing or the wellbore from its distal end towards the surface, and "downhole" as used herein means the direction along the production tubing or the wellbore from the surface towards its distal end. A downhole location means a location along the production tubing or wellbore downhole of the surface.

In the illustrated embodiment, casing 112 has been installed and cemented in place within wellbore 102 to stabilize the wellbore, and production tubing string 114 is positioned within casing 112. Production packer 118 secures and centers production tubing string 114 and isolates the annulus defined by the inner surface of casing 112 and the outer surface of production tubing string 114 (annulus referred to as the "tubing-casing annulus" or TCA) above the production packer from the fluids such as oil 150 and gas 152 flowing from subterranean zone 106 from perforations 116. Such fluids can flow uphole through production tubing string 114 to wellhead 110, and then conveyed from wellhead 110 to surface transportation, treatment, or storage facilities.

In the illustrated embodiment, a subsurface safety valve (SSSV) 120 is installed on production tubing string 114 at a downhole location 119 and includes SSSV flapper 122 which and can provide closure of production tubing string 114 in the event of an emergency (such as a pressure kick or other well control event) or other situation. Production tubing string 114 in the illustrated embodiment further includes a landing nipple 124 at a downhole location 126. Landing nipple 124 can include a machined internal surface to provide a seal area and a locking profile for the installation of a downhole device such as a plug or choke.

In the configuration shown FIG. 1A, well 102 is shut in; that is, production tubing string 114 is closed at or near wellhead 110, such that flow of fluids from production tubing string 114 is stopped. An operator can shut in a well for various purposes, including for testing, fluid injection, or for economic reasons. With the well shut in, the fluids within the production tubing tend to segregate by density, with gas 152 (being less dense than oil 150) accumulating above oil 150 at the uphole end of production tubing string 114, and with any water settling below oil 150.

The pressure (surface force per unit area) exerted at the top of the production tubing at the wellhead when the well is shut in is referred to as the shut-in pressure. In some circumstances, the pressure from the subterranean zone is effectively balanced by the hydrostatic column of fluid in the well, such that the wellhead could be opened to the atmosphere. In other circumstances, the shut-in pressure can be substantially higher than atmospheric pressure. High shut-in pressures (for example, shut-in pressures reaching the design or operating pressure of the Christmas tree) can be a result of a relatively high formation pressure, a high gas-to-oil ratio (GOR), substantial volumes of free gas, a zero or low watercut (the ratio of water produced compared to the volume of total fluid produced) or other factors.

In some circumstances, while the well is shut in, it is desirable to pump treatment fluids such as water, scale inhibitor, or acid stimulation chemicals downhole through the production tubing string and into the subterranean zone. In order to enter the production tubing, such fluids must be injected at a pressure that exceeds the shut-in pressure. A maximum allowable injection pressure can be established which defines the maximum pressure at which fluids can be injected considering equipment factors such as wellhead rating, wellhead working pressure rating, flowline rating, downhole equipment rating, fracture gradient, and other factors. In high shut-in wellhead pressure wells, pumping of treatment fluids can be problematic as the injection can cause the pressure at the wellhead to increase and in some circumstances to reach or exceed the maximum allowable pumping pressure or other threshold.

In accordance with some embodiments of the present disclosure, a method and system is provided to injecting treatment fluids in a downhole direction through a production tubing string of a well having a relatively high shut-in pressure. Such system and method with respect to the well system illustrated in FIG. 1A, and in accordance with some embodiments, is described in reference to FIGS. 1B-1F.

Figure 1B:
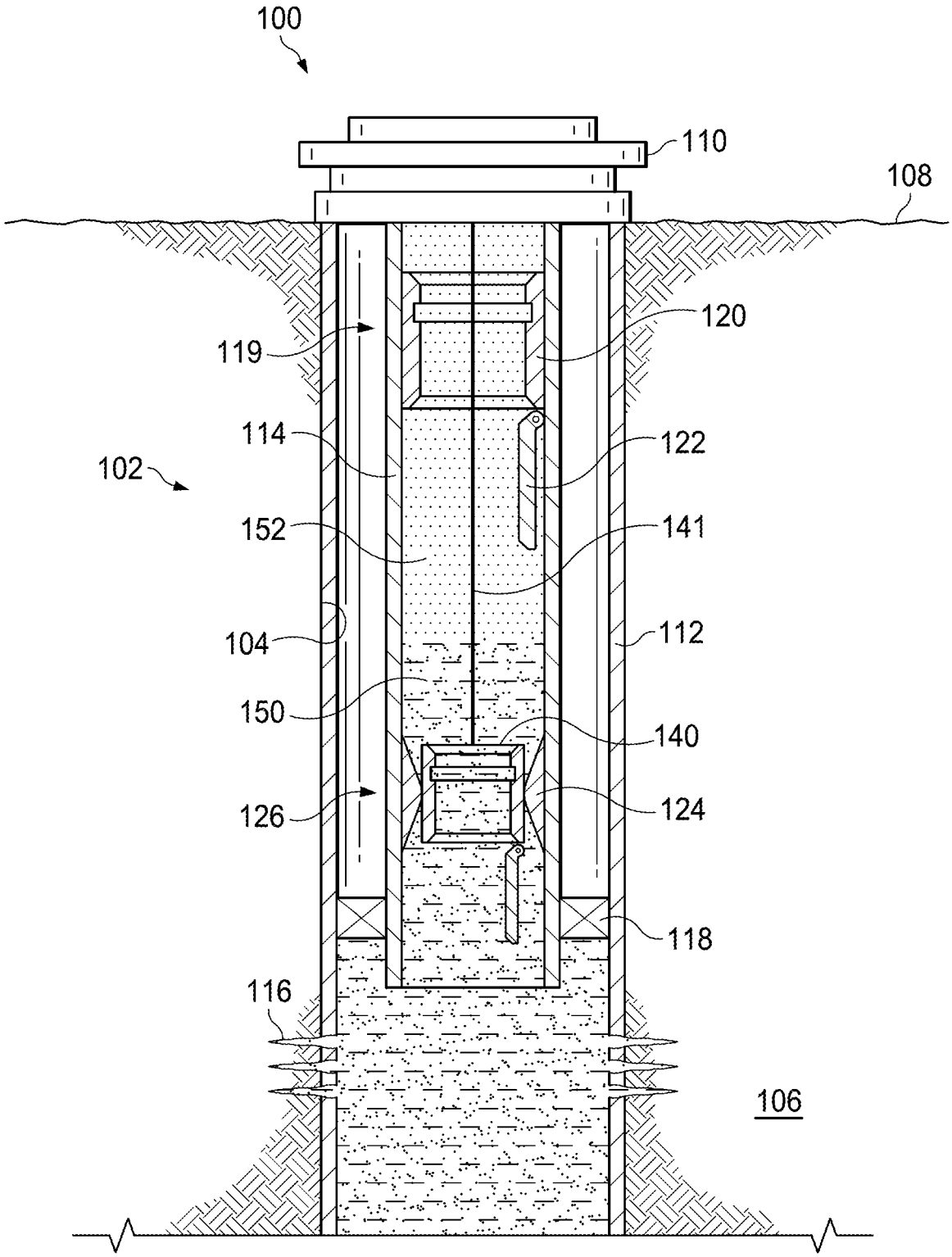

Referring to FIG. 1B, while the well is shut in, a check valve 140 is lowered into production tubing string 114 via a slickline or other suitable conveyance 141 to downhole location 126. In the illustrated embodiment, downhole location 126 is further downhole than the location 119 at which safety valve 120 is positioned. In the illustrated embodiment, check valve 140 is configured to lock into and seal at landing nipple 124. Check valve 140 is configured to prevent fluid flow in an uphole direction when closed. In the illustrated embodiment, check valve 140 is a flapper-type valve with a closure mechanism including a rotating flapper 142 which can close, for example, in response to fluid flow in the uphole direction. In other embodiments, check valve 140 can be a poppet-type valve or other suitable valve. In some embodiments, check valve 140 can be of relatively simple design with no control line from the surface or other control mechanism besides the valve shape, configuration, biasing spring, and other internal components. The closure mechanism of check valve 140 can include a biasing spring or springs that keep flapper 142 normally closed but permit flapper 142 to open and allow fluids to flow in a downhole direction if the differential pressure from above exceeds a specified opening differential pressure. In some embodiments, instead of a landing nipple lock, check valve 140 can include packer elements to land and seal the check valve at downhole location 126 (see FIG. 2).

Figure 1C:
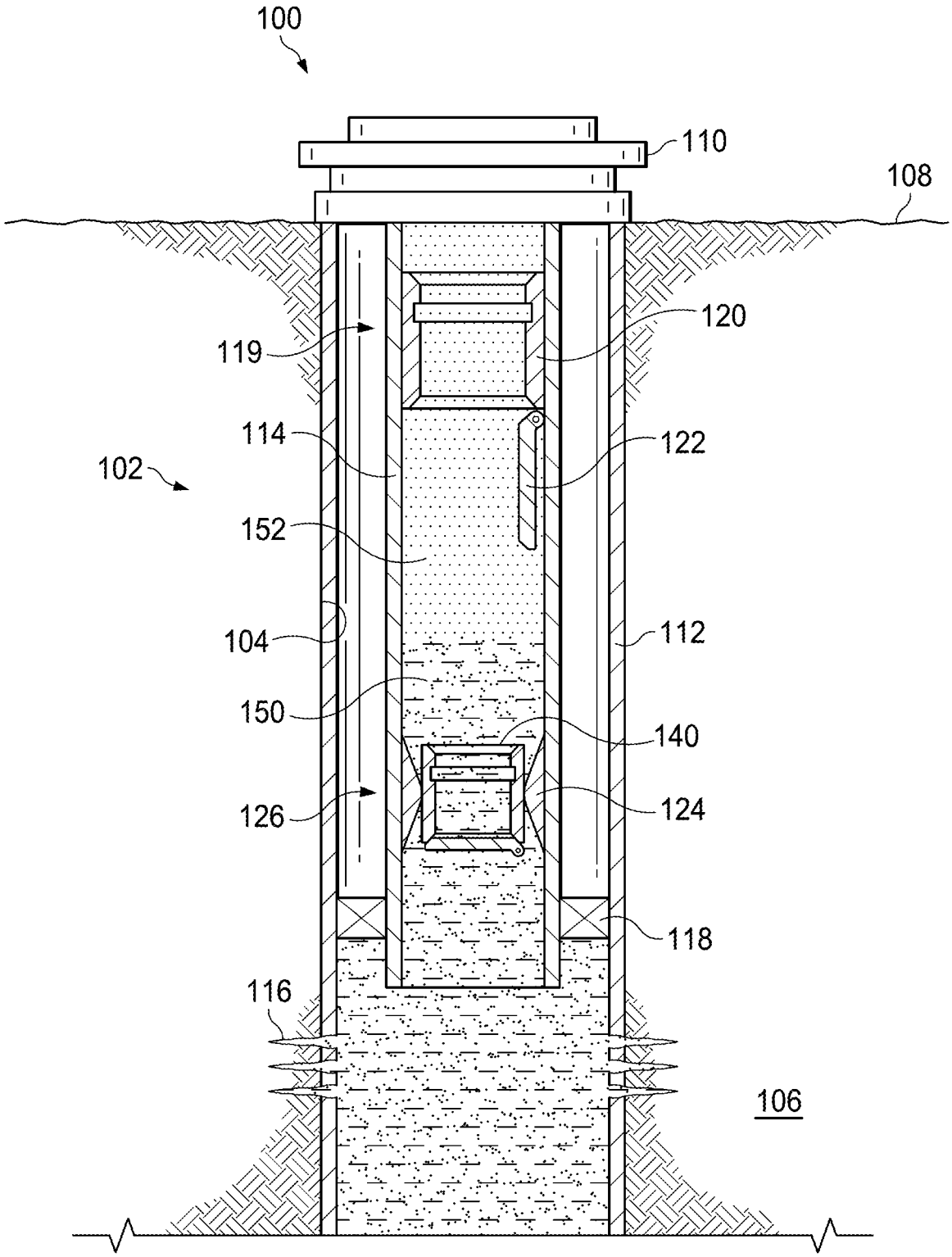
Figure 1D:
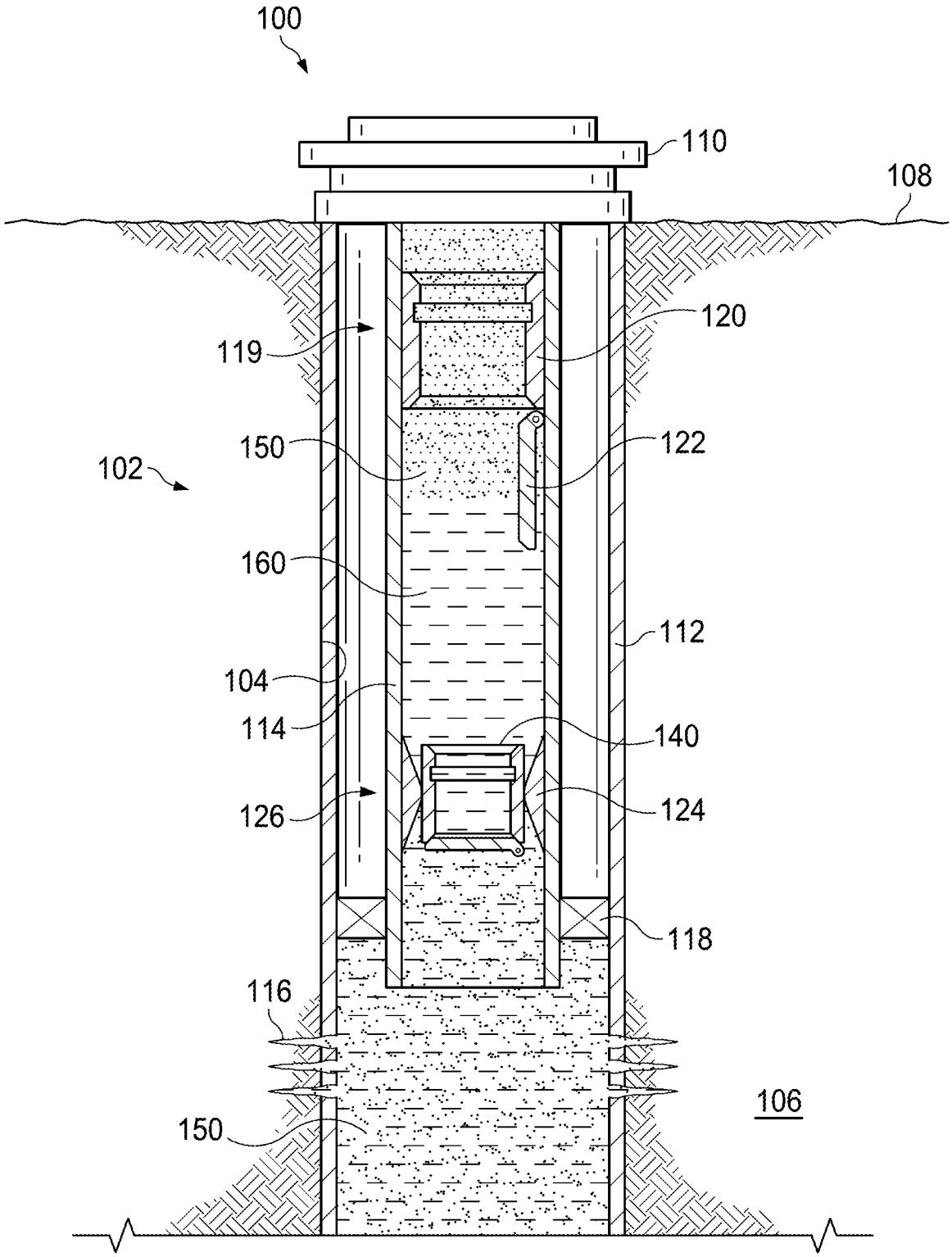

Check valve 140 can be held in an open configuration (for example, by a removable flow tube or other hold-open device) as it is lowered downhole. The flow-tube or other hold-open device can be removed or deactivated after installation, resulting in closure of check valve 140 as shown in FIG. 1C (due to the springs or other biasing mechanism. With check valve 140 closed, a volume of gas is then flowed (bled off) from the production tubing string 114 at wellhead 110, thus reducing the pressure at the wellhead. As shown in FIG. 1D, a volume of water 160 is then pumped into production tubing, at least partially replacing the bled-off volume of gas. The added water has the effect of increasing the hydrostatic pressure within production tubing string 114 at the check valve 140. However, at this stage, the increase in hydrostatic pressure is insufficient to cause the differential pressure across the check valve 140 to exceed the opening differential pressure. Thus, check valve 140 remains closed.

Figure 1E:
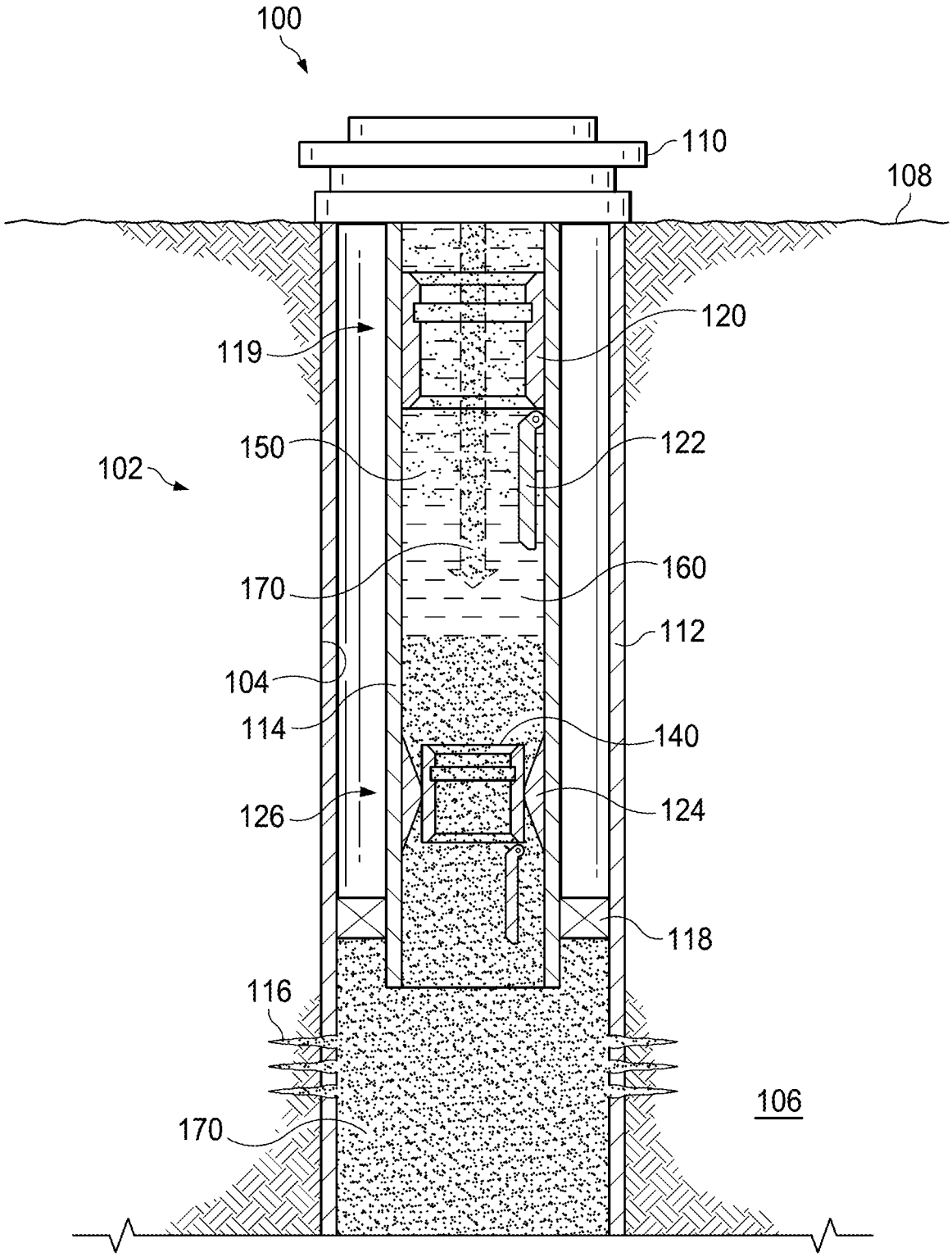

Referring to FIG. 1E, a treatment fluid 170 is injected into production tubing string 114. The treatment fluid can be or can include scale inhibitor, acid stimulation chemicals, water, or other aqueous or non-aqueous compositions. The increase in hydrostatic pressure due to water volume 160 lowers the pressure necessary to inject treatment fluid 170 into production tubing string 114 at the wellhead 110. In some embodiments, treatment fluid 170 is heavier or has a greater density than water. In some embodiments, treatment fluid 170 is lighter or has less density than water. In some embodiments, treatment fluid 170 is a mixture of different fluids of different compositions and/or densities.

Figure 1F:
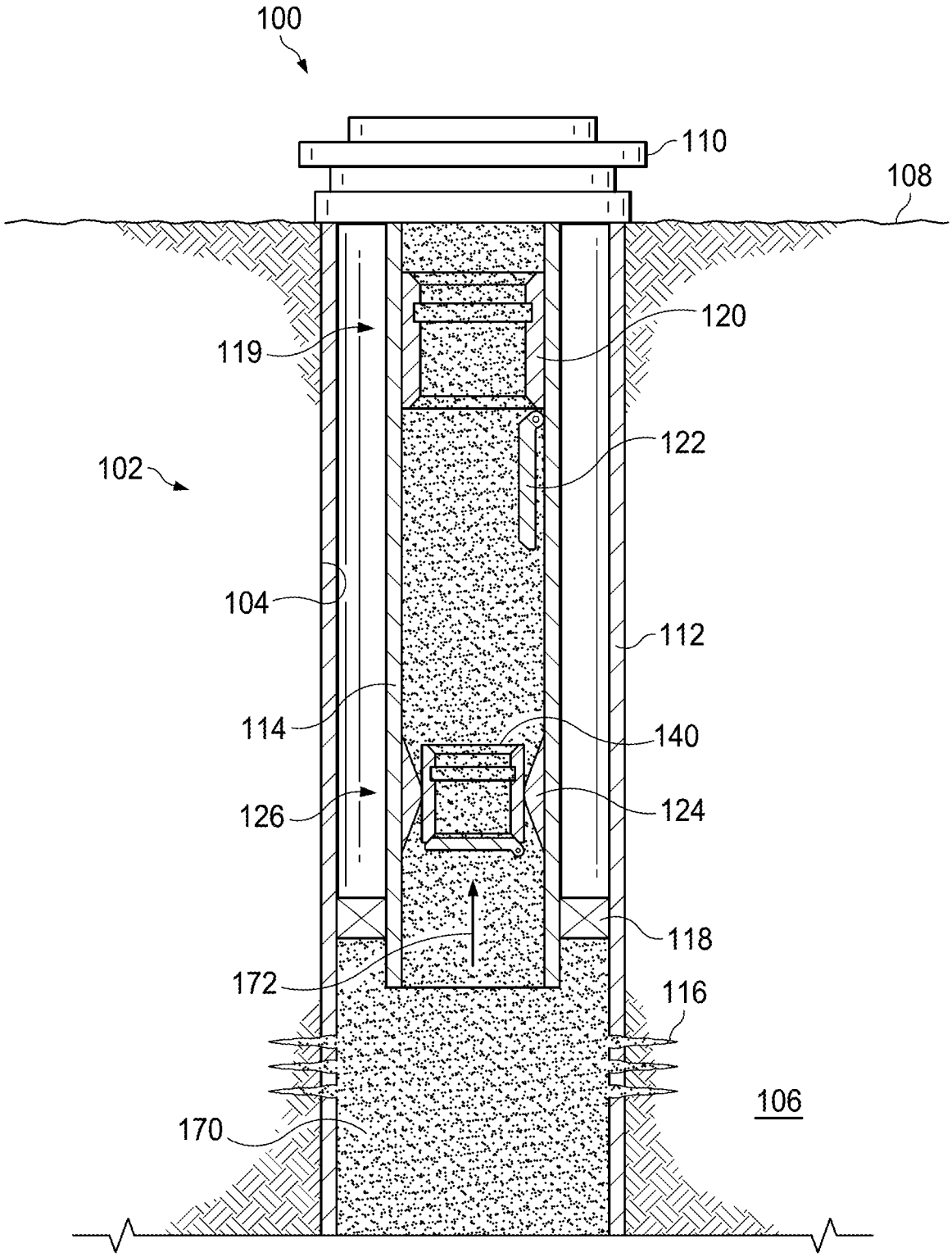

A sufficient volume of treatment fluid 170 injected into production tubing string 114 causes the differential pressure across the check valve 140 to exceed the opening differential pressure, thus opening check valve 140 and permitting the treatment fluid 170 to flow downhole through check valve 140 to a lower portion of production tubing string 114 and into subterranean zone 106. As shown in FIG. 1F, at the conclusion of the injection and in response to the reduction in injection pressure, the biasing springs or other closure mechanisms of check valve 140 cause check valve 140 to close, such that check valve 140 prevents upward flow 172 of treatment fluid or other fluids through production tubing string 114. When it is necessary or desirable to subsequently allow fluid flow in the uphole direction through production string 114 (for example, if it is desired to restart production from well 102), check valve 140 can be removed or reopened with a suitable retrieval or opening device.

In some embodiments, a treatment job design can be established for a given well. Characteristics of the treatment job design and that can be considered in establishing the treatment job design can include some or all of the initial shut in pressure, the maximum allowable injection pressure, the volume and desired injection pressure of the treatment fluid, the construction, overall volume, and other characteristics of the production tubing string and its components, the pressure, temperature, and other characteristics of the subterranean zone, the desired treatment or injection type, and other well and/or treatment job attributes or considerations. A specified volume of water necessary or desirable to be pumped in prior to injection can be calculated and selected so to increase the hydrostatic pressure as necessary to lower the injection pressure to the desired level while keeping check valve 140 closed prior to treatment fluid injection. Likewise, the opening differential pressure of check valve 140 can be calculated and selected based on such a treatment job design. Check valve 140 can, for example, be configured or calibrated to have a specified opening differential pressure and other characteristics to enable and perform a given treatment job design for a given well. Such calibration (to establish a calibrated state of the check valve) can be done, for example, by fitting check valve 140 with biasing springs or pistons constructed or configured to have a specified spring constant (an/or required opening compression or tension), and/or by otherwise selecting and/or configuring the shape, size, components, or other design feature of check valve 140, such that check valve 140 will open at the desired specified opening differential pressure when positioned downhole.

As an example of the effectiveness of the system and method of the present disclosure, consider an example well with an average hydrostatic pressure gradients of 0.2 pounds per square inch (psi) per foot for gas, 0.3 psi per foot for oil, and 0.433 psi per foot for water. The well has an average hydrostatic pressure gradient of 0.33 psi per foot and a shut-in wellhead pressure of 1500 psi. The hydrostatic pressure at the nipple depth of 5708 feet is 3383 psi, and the top of reservoir pressure is 4053 psi. If, in accordance with the method described above in reference to FIGS. 1A-1F, a check valve can be installed at the nipple depth and the valve closed. A volume of gas is then bled off from the production tubing, thus decreasing the pressure within the production tubing at the wellhead (and thus decreasing the pressure necessary to inject a treatment fluid). A portion of the removed volume of gas is replaced by flowing water into the production tubing, such that the average hydrostatic pressure gradient would be increased to 0.4 psi per foot and the hydrostatic pressure at the check valve at nipple depth would be 3783 psi. Because of the increased hydrostatic head at the check valve due to the column of water, a lesser injection pressure of treatment fluid is required to open the check valve to flow the treatment fluid downhole past the check valve into the formation, as compared to if the added water were not present. Thus, in this example, the injection pressure required to open the check valve is 400 psi (i.e., 3783 psi-3383 psi) less than the injection pressure that would be required to open the check valve if the water were not present.

Figure 2:
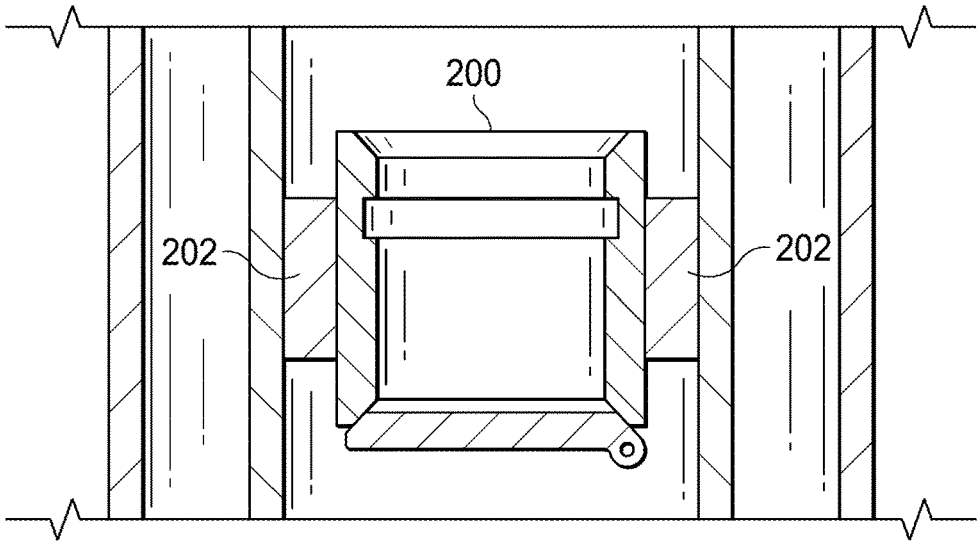
FIG. 2 is a schematic illustration of an alternative check-valve design in accordance with an embodiment of the present disclosure.

FIG. 2 is a schematic illustration of an alternative check-valve design in accordance with an embodiment of the present disclosure. Referring to FIG. 2, check valve 200 is a flapper valve similar to check valve 140 of FIG. 1B. However, instead of locking into a nipple profile as with check valve 140 of FIGS. 1B, check valve 200 includes packer elements 202 to install and seal the check valve at the downhole deployment location within the production packer. In some embodiments packer elements 202 can be inflatable packer elements, mechanically activated elements, swellable elements, or other suitable packer elements. Such a check valve design with packer elements can be utilized and may be advantageous, for example, if a landing nipple profile is not present at the downhole depth desired for the treatment job design.

Figure 3:
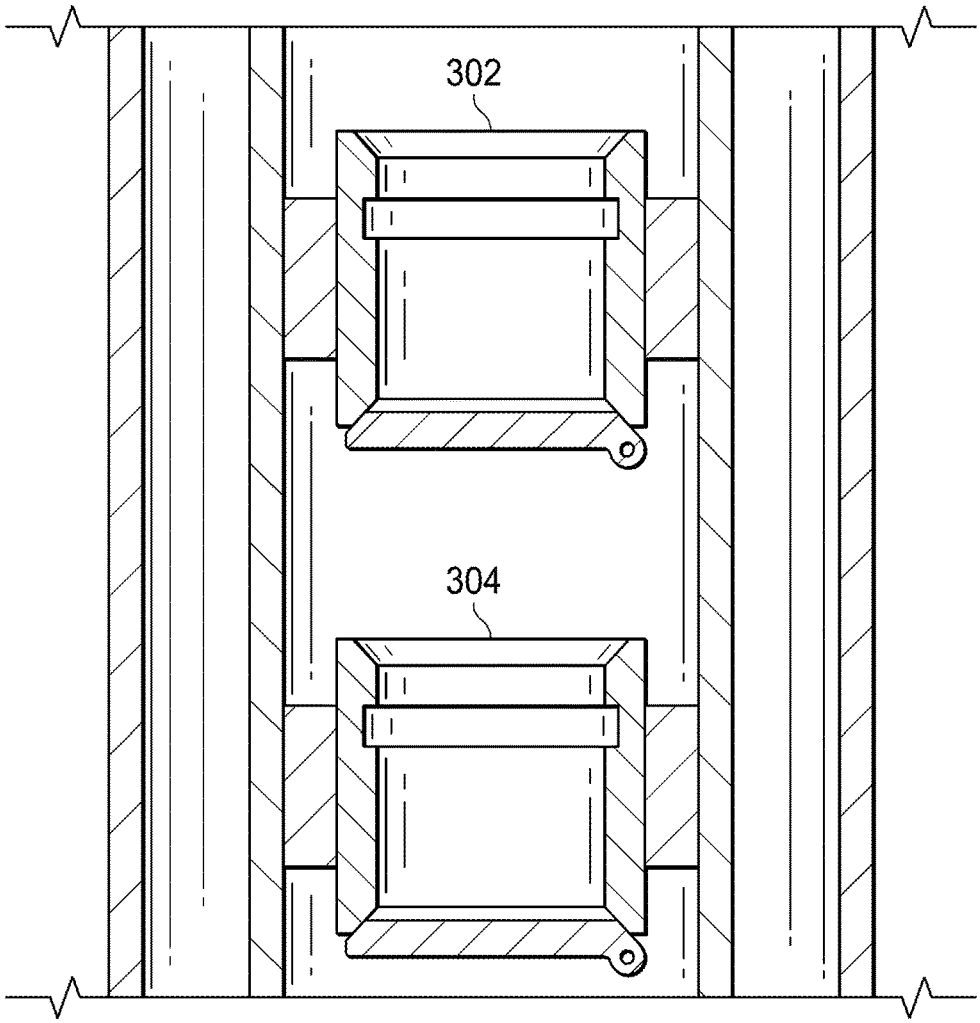
FIG. 3 is a schematic illustration of an alternative check-valve configuration in accordance with an embodiment of the present disclosure.

FIG. 3 is a schematic illustration of an alternative check-valve configuration in accordance with an embodiment of the present disclosure. Referring to FIG. 3, a plurality of check valves—in the illustrated embodiment, two check valves 302 and 304—are installed in vertical sequence in the production tubing instead of one check valve. Such a configuration can advantageous in that it can provide a backup to maintain closure of the production tubing in the event one check valve fails as the gas is flowed from the well.

Figure 4:
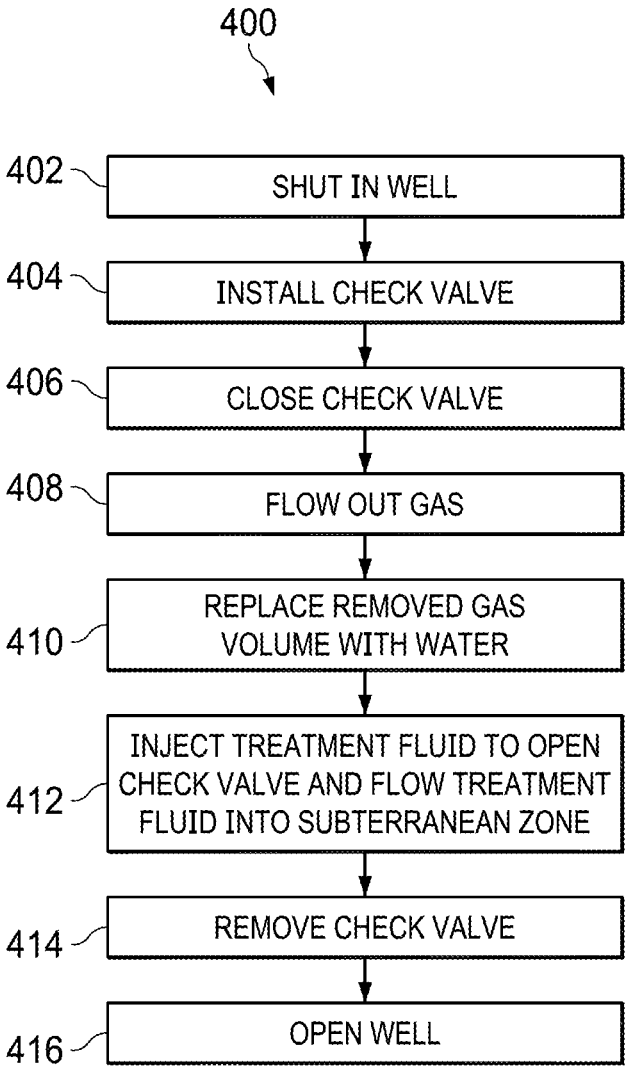
FIG. 4 is a process flow diagram of a method of injection of a treatment fluid in accordance with an embodiment of the present disclosure.

FIG. 4 is a process flow diagram of a method 400 of injection of a treatment fluid into a production well drilled into a subterranean formation in accordance with an embodiment of the present disclosure. The method begins at step 402 in which the production well is shut in. Within the production tubing string of the shut-in well, oil, gas, water, and other fluids in the well will segregate by density within the production tubing string of the well. Proceeding to step 404, while the well is shut in, a check valve is lowered by a suitable conveyance and installed within a production tubing string. The check valve prevents fluid flow in an uphole direction but allows fluid flow in a downhole direction if the differential pressure across the check valve exceeds an opening differential pressure. In some embodiments, the check valve is lowered via a slickline. In some embodiments, the check valve is lowered through a safety valve positioned in the production tubing string at a location uphole of the check valve target location. In some embodiments, the check valve is held open during the lowering by a flow tube or other hold-open mechanism.

Proceeding to step 406, the operator closes the check valve. Such closure can be, for example by removing the flow tube. At step 408, a volume of the gas above the gas-oil interface is flowed from the well. Pressure is thereby decreased within the production tubing string at the wellhead. Proceeding to step 410, a volume of water is pumped or otherwise flowed into the production tubing string to at least partially replace the volume of gas flowed from the production tubing string at step 410. The presence of the added water within the production tubing string increases a hydrostatic pressure within the production tubing string at the check valve. In some embodiments, while the increase in hydrostatic pressure caused by the presence of the water insufficient to cause the differential pressure across the check valve to exceed the opening differential pressure, further injection of fluids (such as treatment fluids as described with respect to step 412 below). However, the presence of the added water reduces the additional pressure that must be added to the tubing string in order to open the check valve.

Proceeding to step 412, a treatment fluid such stimulation fluids or acidizing fluids is injected into the production tubing at a sufficient pressure to open the check valve and flow the treatment fluid into the subterranean zone. Because the presence of the added water reduces the additional pressure that must be added to the tubing string in order to open the check valve, the treatment fluid can be injected at a lower pressure than would otherwise be necessary.

After the treatment job is complete, the check valve can, at step 414, be removed or opened as is suitable any further operations with respect to the well. At step 416, the well can be opened and returned to production.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method of injecting fluids in a downhole direction through a production tubing string, wherein the production tubing string is positioned below a wellhead in a well drilled into a subterranean zone and wherein an initial shut-in pressure within the production tubing string at the wellhead is a first wellhead pressure, the method comprising:

closing, while the well is shut in, a check valve positioned at a downhole location within the production tubing string, the check valve operable to prevent fluid from flowing in an uphole direction through the production tubing string and configured to open to allow fluid in the downhole direction when a differential pressure across the check valve exceeds a specified opening differential pressure;

flowing, with the check valve closed, a specified volume of gas from the production tubing string above the check valve, thereby decreasing the pressure within the production tubing string at the wellhead from the first wellhead pressure to a second wellhead pressure less than the first wellhead pressure;

increasing a hydrostatic pressure within the production tubing string at the check valve by flowing a specified volume of water into the production tubing string above the check valve to at least partially replace the specified volume of gas;

injecting, after flowing the specified volume of water into the production tubing string and at an injection pressure less than the first wellhead pressure and greater than the second wellhead pressure, a specified volume of treatment fluid into the production tubing string, thereby opening the check valve by causing the differential pressure across the check valve to exceed the specified opening differential pressure and thereby flowing the treatment fluid downhole through the check valve.

2. The method of claim 1, wherein the increasing of the hydrostatic pressure from the flowing of the volume of water into the production tubing string is insufficient to cause the differential pressure across the check valve to exceed the specified opening differential pressure.

3. The method of claim 2, wherein the injecting of the treatment fluid after the flowing of the water is sufficient to cause the differential pressure across the check valve to exceed the specified opening differential pressure.

4. The method of claim 1, further comprising calibrating the check valve to open at the specified opening differential pressure based on at least one characteristic of a well treatment job design.

5. The method of claim 1, further comprising lowering the check valve to the downhole location.

6. The method of claim 5, wherein the lowering the check valve is by a slickline.

7. The method of claim 5, wherein a landing nipple is positioned in the production tubing string at the downhole location and wherein positioning the check valve at the downhole location comprises landing the check valve on the landing nipple.

8. The method of claim 5, wherein the downhole location is downhole of a subsurface safety valve.

9. The method of claim 5, wherein the check valve comprises a packer element configured to selectively expand at the downhole location.

10. The method of claim 9, wherein the packer element is an inflatable packer element.

11. The method of claim 1, wherein the check valve is a flapper-type valve.

12. The method of claim 1, wherein the check valve is a first check valve and further comprising positioning a second check valve downhole of the first check valve, the second check valve configured to open to allow fluid in the downhole direction when a differential pressure across the check valve exceeds the specified opening differential pressure and to prevent fluid from flowing in the uphole direction through the production tubing string in the event of failure of the first check valve.

13. A system for injecting a fluid into a production tubing string, wherein the production tubing string is positioned below a wellhead in a well drilled into a subterranean zone and wherein an initial shut-in pressure within the production tubing string at the wellhead is a first wellhead pressure, the system comprising:

a landing nipple positioned in the production tubing string at a downhole location;

a check valve configured to land on the landing nipple, the check valve calibrated based on at least one characteristic of a well treatment job design to have a specified calibrated state, the specified calibrated state such that, when the check valve is positioned in the tubing string on the landing nipple:

the check valve can close and remain closed as:

a specified volume of gas from the production tubing string is flowed from the production tubing string above the check valve, thereby decreasing the pressure within the production tubing string at the wellhead from the first wellhead pressure to a second wellhead pressure less than the first wellhead pressure; and a hydrostatic pressure within the production tubing string at the check valve is increased by flowing a specified volume of water into the production tubing string above the check valve to at least partially replace the specified volume of gas; and the check valve opens as, after flowing the specified volume of water into the production tubing string and at an injection pressure less than the first wellhead pressure and greater than the second wellhead pressure, a specified volume of treatment fluid is flowed into the production tubing string that causes a differential pressure across the check valve to exceed a specified differential pressure at which the check valve opens.

14. The system of claim 13, further comprising a subsurface safety valve positioned in the production tubing string uphole of the landing nipple.

15. The system of claim 13, wherein the check valve comprises a packer element configured to selectively expand at the downhole location.

16. The system of claim 15, wherein the packer element is an inflatable packer element.

17. The system of claim 13, wherein the check valve is a flapper-type valve.

18. The system of claim 13, wherein the check valve is a first check valve and further comprising a second check valve positioned downhole of the first check valve, the second check valve configured to open to allow fluid in a downhole direction when a differential pressure across the check valve exceeds the specified opening differential pressure and to prevent fluid from flowing in the uphole direction through the production tubing string in the event of failure of the first check valve.

* * * * *